US006647833B1

(12) United States Patent
Wu

(10) Patent No.: US 6,647,833 B1
(45) Date of Patent: Nov. 18, 2003

(54) RATCHET WRENCH

(76) Inventor: Arthur Wu, No. 22, Alley 28, Lane 360, Chung Shan Rd., She Kou Village, Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/351,330

(22) Filed: Jan. 27, 2003

(51) Int. Cl.[7] ..... B25B 13/46
(52) U.S. Cl. ..... 81/63.2; 81/60; 81/63
(58) Field of Search ..... 81/63.2, 63, 62, 81/61, 60, 63.1

(56) References Cited

U.S. PATENT DOCUMENTS 3,269,496 A * 8/1966 Kilness ..... 192/43.2
5,533,427 A * 7/1996 Chow ..... 81/63.2
6,065,374 A * 5/2000 Taggart ..... 81/63.2
6,435,062 B1 * 8/2002 McCann ..... 81/63
6,516,692 B1 * 2/2003 Hsien ..... 81/63.2
6,543,316 B2 * 4/2003 Daigle et al. ..... 81/63

* cited by examiner

*Primary Examiner*—Joseph J. Hail, III
*Assistant Examiner*—Hadi Shakeri
(74) *Attorney, Agent, or Firm*—Bacon & Thomas PLLC

(57) ABSTRACT

A ratchet wrench comprises a handle having a head portion, provided with a through hole, a first chamber and a second chamber. A toothed driving device is installed in the through hole for free rotation. A toothed pawl is received in the first chamber to detachably mesh with the driving device. A switching device has an axle member received in the second chamber for free rotation and a turning member. A U-shaped supporting device, has two parallel extending segments inserted into two holes on the axle member of the switching device, and a spring is provided for driving a contacting segment of the supporting device.

6 Claims, 7 Drawing Sheets

RATCHET WRENCH

BACKGROUND OF THE INVENTION

1. Field of the Invention

The present invention relates generally to a hand tool, and more particularly to a ratchet wrench, which can provide larger power and can drive a pawl moving stably.

2. Description of the Related Art

FIG. 9 shows a conventional ratchet wrench 8, which comprises a handle 80 having a head portion 81 at an end thereof. The head portion 81 is provided with a through 811, a first chamber 812 and a second chamber 813. A driving device 82 having teeth 821 at a annular outer surface thereof is installed in the through hole 811 via a C-ring 88 such that the driving device is rotatable. A pawl 83 is received in the first chamber 812 meshed with the teeth 821 of the driving device 82. A switching device 84 is received in the second chamber 813, which has a recess 841 along a diameter orientation thereof in which installs a spring 85 and a bullet 86. The bullet 86 elastically pushes the pawl 83. A positioning member 87 is installed in a recess 814 on a sidewall of the second chamber 813 against the switching device 84.

The combination of the spring 85 and the bullet 86 generally has two functions, one of which is elastically pushing the pawl 83 to make it meshed with the teeth 821 of the driving device 82, the other one of which is moving the pawl 82 to right side or left side of the first chamber 812. The driving device 82 is turned with the handle 80 when the handle 80 is turned forwards, so that the driving device 82 can turn a nut or a bolt. But, when the handle 80 is turned reversibly, the driving device 82 will keep still.

FIG. 10 shows another conventional ratchet wrench 9, which is similar to aforesaid conventional ratchet wrench 8, except that an elongated piece element 96 is replaced with the bullet 86 of the ratchet wrench 8. The elongated piece element 96 works for same functions.

In practice, the driving device 82 will be driving to turn more or less when the handle 80 is turned reversibly. This trend of the driving device is requested to be less, otherwise, the wrench will unable to turn a loosed nut or bolt.

A considerable reason of aforesaid result is the strength of the spring. It is asked to as less as possible so that the bullet 86 (or the piece element 96) will has less affect of the pawl departing from the driving device when the handle is turned reversibly. But, a spring with smaller strength might cause the pawl cannot mesh with the driving device securely when the handle is turned forwards.

SUMMARY OF THE INVENTION

The primary objective of the present invention is to provide a ratchet wrench, which has less capacity of driving a driving device turning when the wrench is turned reversibly.

According to the objectives of the present invention, a ratchet wrench comprises a handle having a head portion at an end thereof, a through hole, a first chamber and a second chamber at the head portion, wherein the first chamber has opposite sides thereof communicated with the through hole and the second chamber respectively. A driving device has a polygonal hole at a center thereof and teeth at an outer side thereof whereby the driving device is installed in the through hole of the handle for free rotation. A pawl has teeth at a side thereof and a driven portion at an opposite side thereof, whereby the pawl is received in the first chamber and detachably meshes the teeth thereof with the teeth of the driving device. A switching device has an axle member and a turning member at an end of the axle member, wherein the axle member is received in the second chamber of the handle for free rotation and the turning member is left out of the handle. A supporting device, which is substantially a strip element, has two substantially parallel extending segments and a contacting segment with opposite ends thereof connected with distal ends of the extending segments, wherein proximal ends of the extending segments are movably connected with the axle member of the switching device and the contacting segment is received in the first chamber of the handle, and means for driving the contacting segment having at least a part thereof elastically against the pawl at the driven portion.

DETAILED DESCRIPTION OF THE INVENTION

Figure 1:
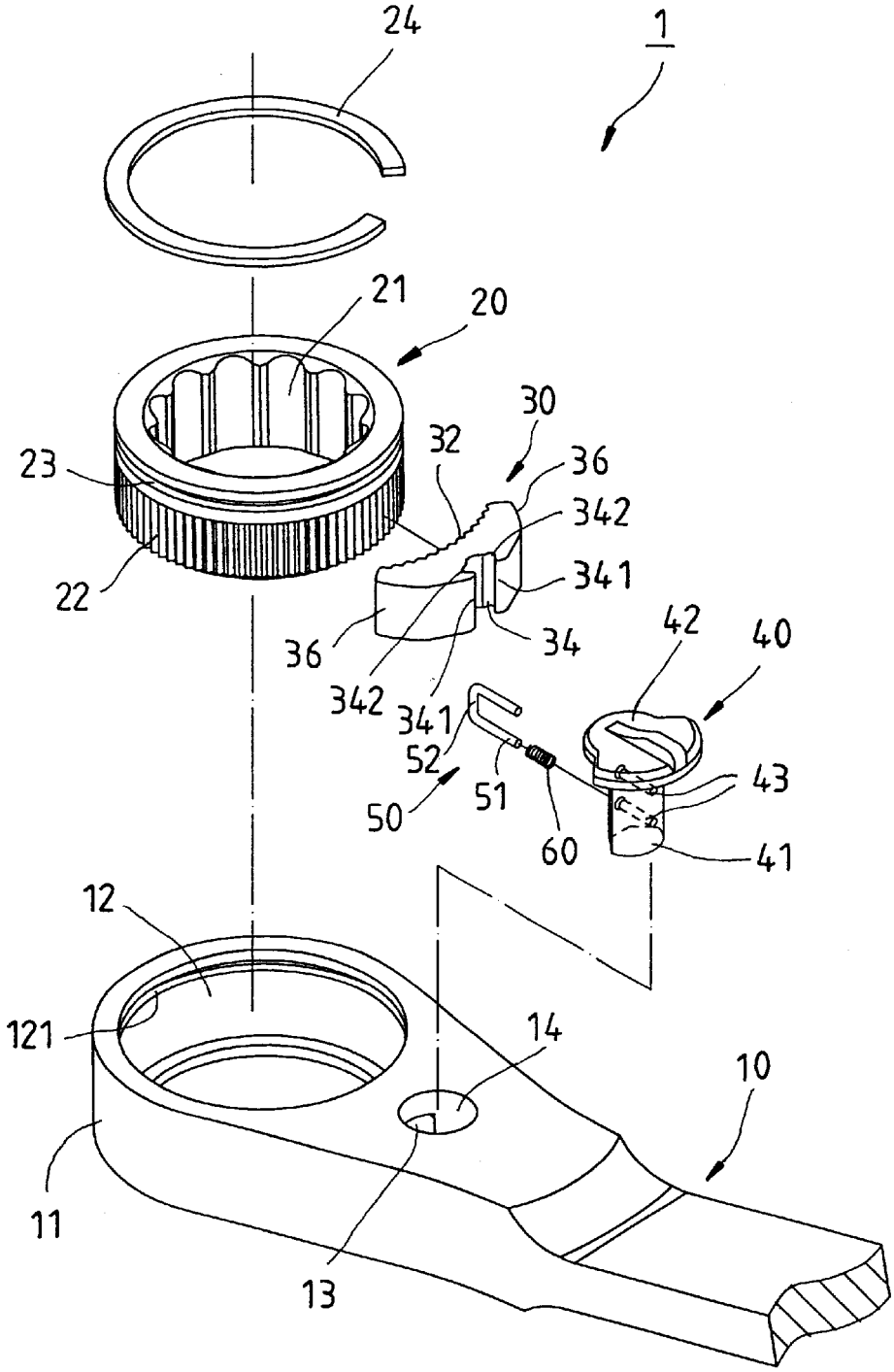
FIG. 1 is an exploded view of a preferred embodiment of the present invention.
Figure 2:
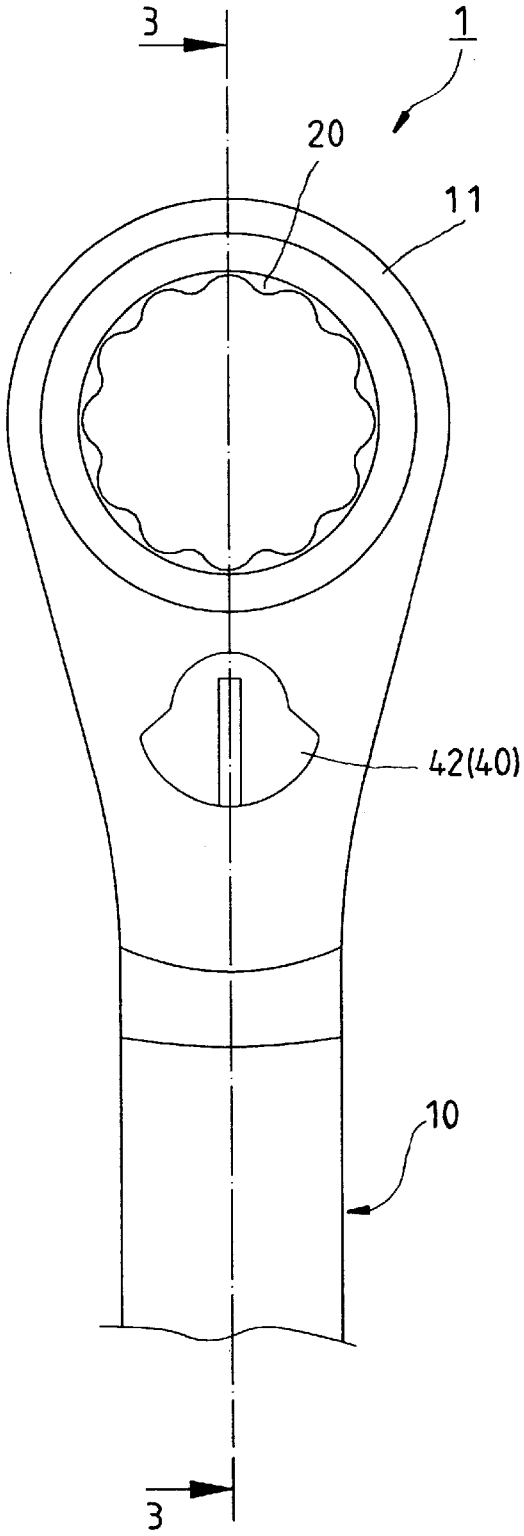
FIG. 2 is a top view of the preferred embodiment of the present invention.
Figure 3:
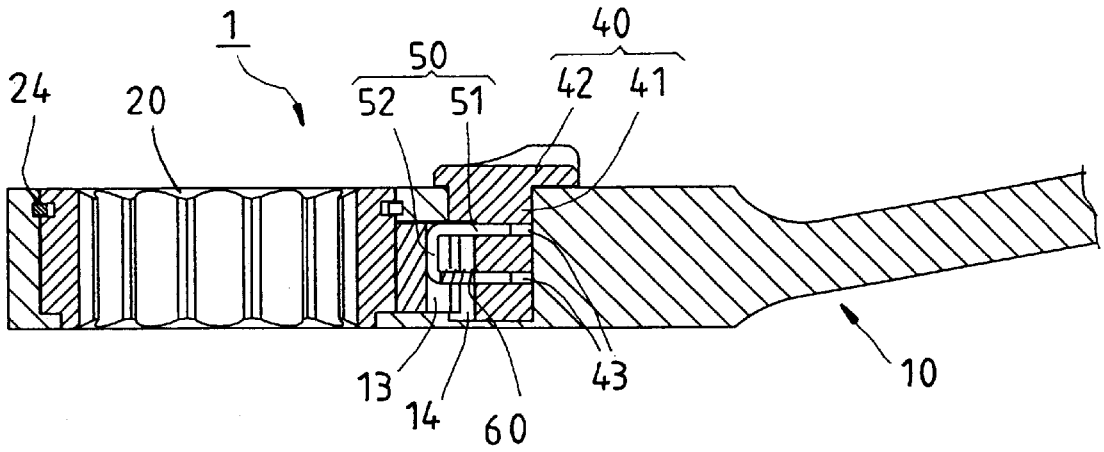
FIG. 3 is a sectional view along a 3—3 line in FIG. 2.
Figure 4:
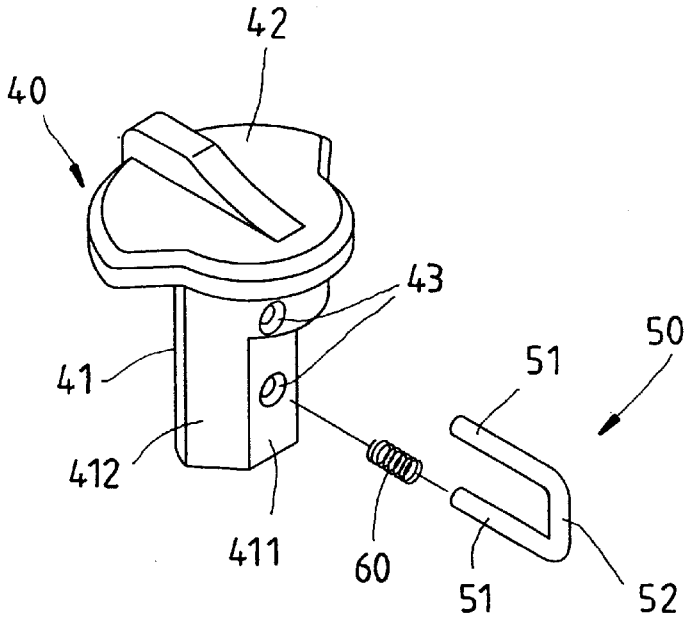
FIG. 4 is a perspective view of a switching device, a supporting device and a spring.

Please refer to FIGURES. from FIG. 1 to FIG. 3, a ratchet wrench of the preferred embodiment of the present invention mainly comprises a handle 10, a driving device 20, a pawl 30, a switching device 40, a supporting device 50 and a spring 60, wherein The handle 10 has a head portion 11 at an end thereof at which is provided with a through hole 12, a first chamber 13 and a second chamber 14. The first chamber 13 is located between the through hole 12 and the second chamber 14 and is communicated with both of them. The first chamber 13 is closed at both sides of the handle 10 and the second chamber 14 is opened at a first side thereof and is closed at the an opposite side thereof. The handle 10 disposes an annular slot 121 at a sidewall of the through hole 12 and a recess 141 at a bottom sidewall of the second chamber 14.

The driving device 20 has a hexagonal hole 21 (or a dodecahedral hole) at center for engaged with a nut or a bolt (not shown). The driving device 20 further has annular teeth 22 at an outer surface and an annular slot 23 beside the teeth 22. The driving device 20 is received in the through hole 12 of the handle 10 with a retaining ring 24 installed in the annular slots 121 and 23 to lock the driving device 20 and make it can free rotate.

Figure 10:
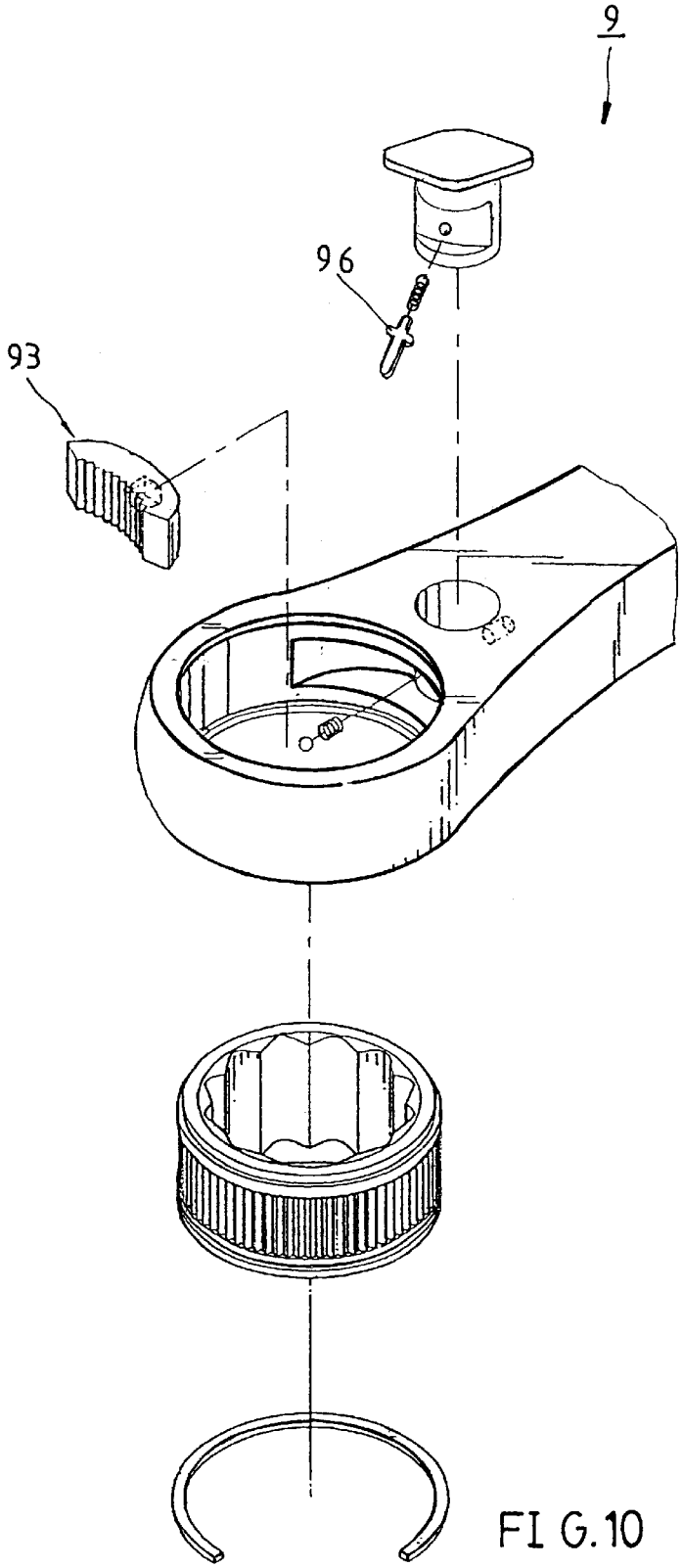
FI G.10 PRIOR ART
FIG. 10 is an exploded view of another conventional ratchet wrench.

The pawl 30 has teeth 32 at a side thereof, a driven portion 34 at an opposite side thereof and two against portions 36 beside the driven portion 34 respectively. The driven portion 34 is a cavity in the present preferred embodiment having a curved-inward surface and two lug portions 341 and two recesses 342 at two sides of the surface respectively, wherein the lug portions 341 are located at outsides of the recesses 342 respectively. The pawl 30 is installed in the first chamber 13 of the handle 10 to be driven to left side (FIG. 8) and to right side (FIG. 10) of the first chamber 13.

The switching device 40 has an axle member 41 and a turning member 42 at an end of the axle member 41. The axle member 41 is a column in this prefer embodiment having a flat face 411 and two inclined faces 412 at opposite sides of the flat face 411 respectively, wherein the flat face 411 is provided with two holes 43 thereon along a diameter orientation of the axle member 41. The axle member 41 is received in the second chamber 14 and the turning member 42 is left out of the second chamber 14.

The supporting device 50 is substantially a U-shaped strip-like element having two extending segments 51 and a contacting segment 52 connecting its opposite ends to distal ends of the extending segments 51 respectively. Free ends of the extending segments 51 are inserted into the holes 43 on the axle member 41 of the switching device 40.

In the present preferred embodiment, the supporting device 50 is made from bending a single strip. The wire can be metal strip, spring strip or plastics strip. The supporting device 50 typically is a rigid body, but the contacting segment 52 may allow having flexibility. The shape of the contacting segment 52 can be straight (as shown in FIGS.), convex, concave or a shape corresponding to the surface of the driven portion 34 of the pawl 30.

The spring 60 is installed on one of the extending segments 51 so that it has an end thereof against the contacting segment 52 of the supporting device 40 and the other end thereof against the flat face 411 of the axle member 41. Such that, the contacting segment 52 will rest against the driven portion 34 of the pawl 30 to make the supporting device 50 elastically pushes the pawl 30.

Figure 5:
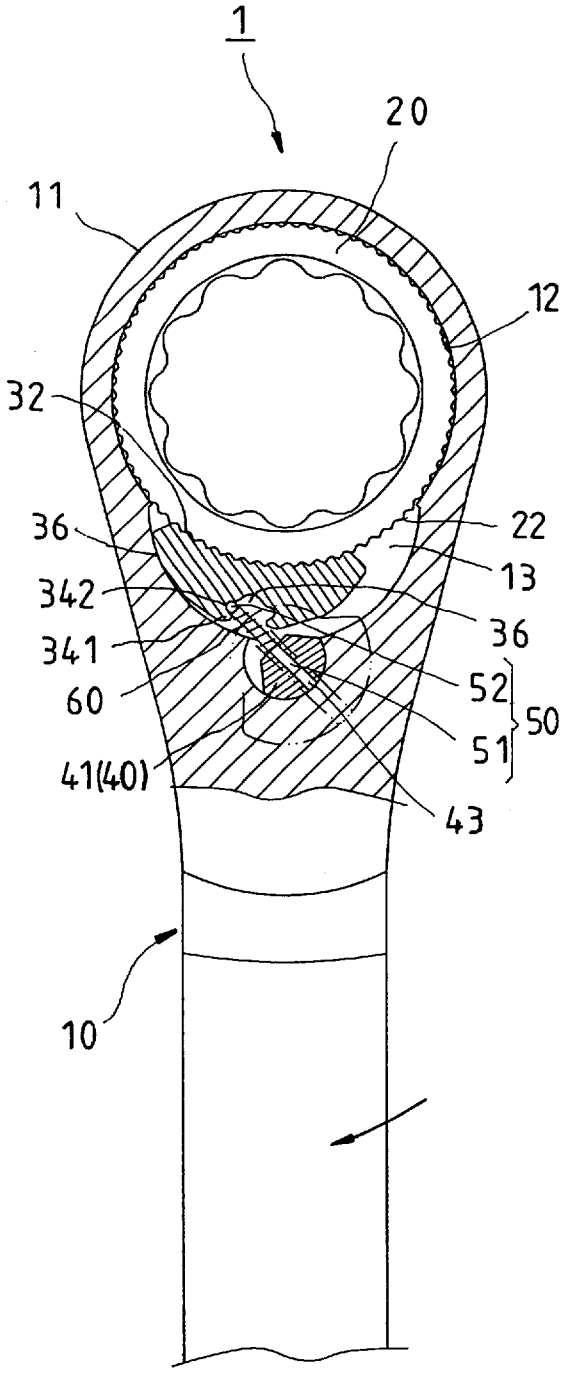
FIG. 5 is a sectional view from a top of the preferred embodiment of the present invention, showing the pawl moved to left side. and the handle turned counterclockwise to loose a nut or a bolt.

FIG. 5 shows the switching device 40 being turned to right such that the contacting segment 52 of the supporting device 50 is driven to slide along the driven portion 34 to a left side thereof and fall into the recess 342 at the left side thereof The pawl 30 is driven to move to a left side of the first chamber 13 via the supporting device 50 and rest the against portion 36 at the left side thereof against a left sidewall of the first chamber 13.

When the handle 10 is turned clockwise, the teeth 22 and 32 of the driving device 20 and pawl 30 will be meshed with each other in tight condition such that the driving device 20 will be turned with the handle to loosen a nut or bolt (not shown).

Figure 6:
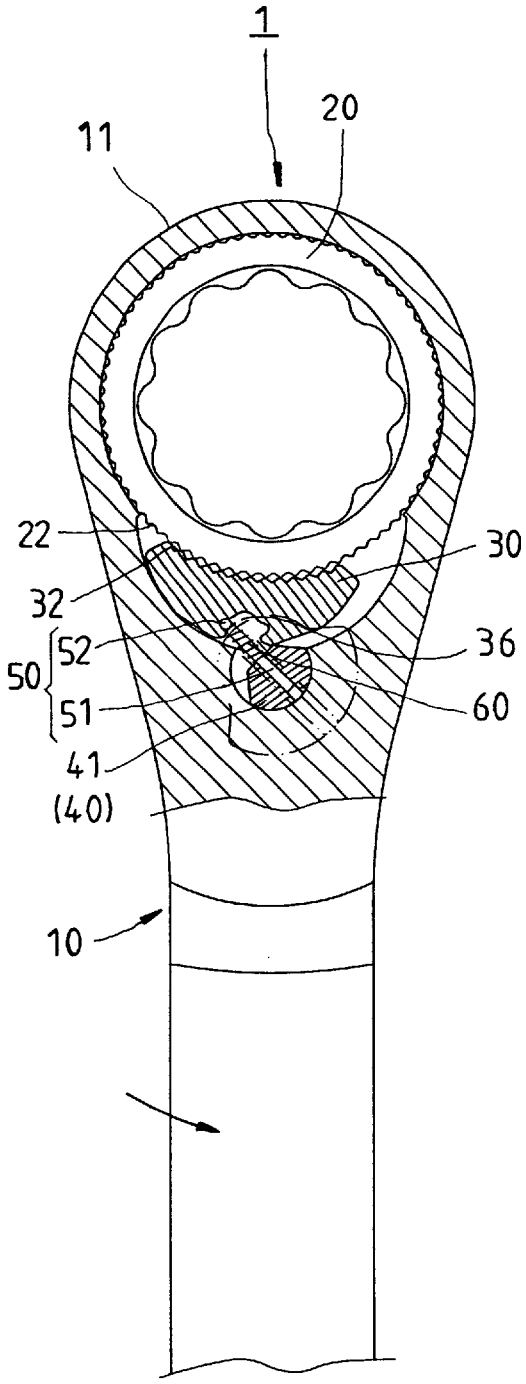
FIG. 6 is a sectional view following FIG. 5, showing the handle turned clockwise and the pawl departing from the driving device to make the driving device keeping still.

FIG. 6 shows the handle 10 being turned counterclockwise and the pawl 30 being moved away from the driving device 20 to disengage the teeth 22 and 32 of the driving device 20 and the pawl 30. Therefore, the driving device 20 will remain stationary while the handle 10 is turned clockwise. Under such condition, the supporting device 50 will be pushed backwards to compress the spring 60 and the spring 60 will provide an elastic force back to the supporting device 40 to push the pawl 30 into meshed engagement with the driving device 20 again.

Figure 7:
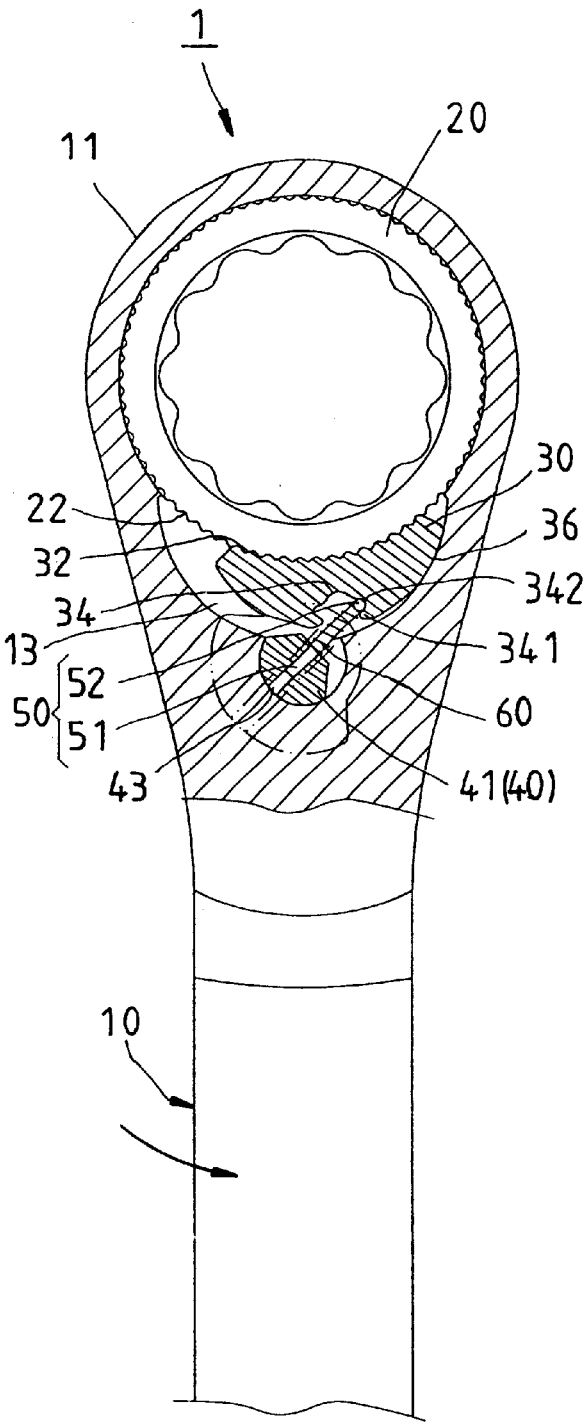
FIG. 7 is a sectional view from a top of the preferred embodiment of the present invention, showing the pawl moved to right side and the handle turned clockwise to loose a nut or a bolt.
Figure 8:
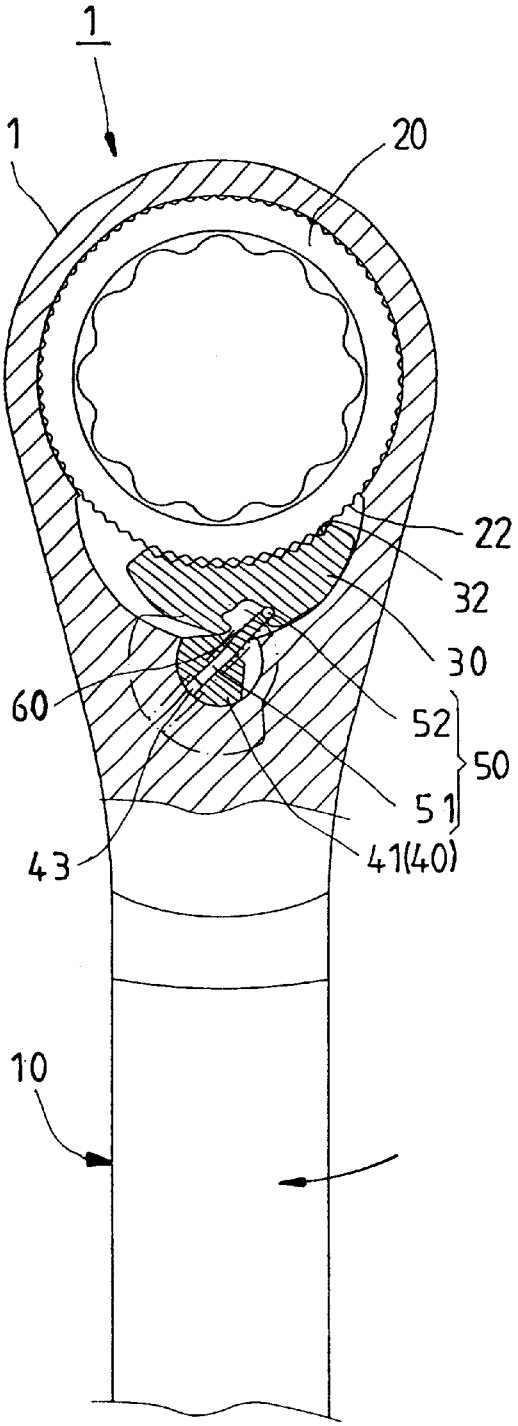
FIG. 8 is a sectional view following FIG. 7, showing the handle turned counterclockwise and the pawl departing from the driving device to make the driving device keeping still.
Figure 9:
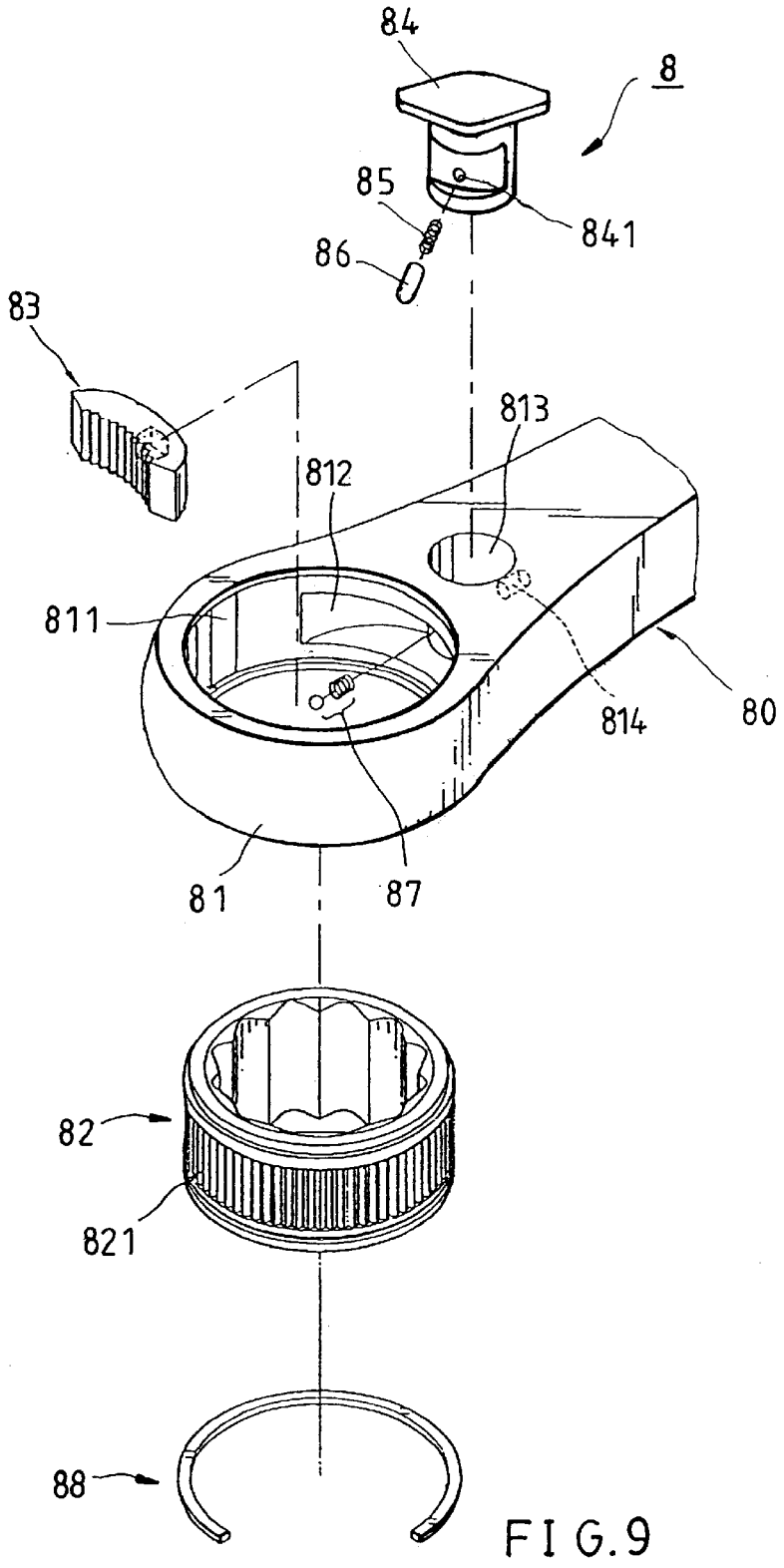
FIG.9 PRIOR ART
FIG. 9 is an exploded view of a conventional ratchet wrench.

FIG. 7 shows the switching device 40 turned left to permit the pawl 30 to be moved to a right side of the first chamber 14 via the supporting device 40 and the (A handle 10 is turned counterclockwise to permit the driving device 20 to turn a nut or a bolt (not shown) tight. FIG. 8 shows the handle 10 turned clockwise and the driving device 20 still is stationary.

To achieve the purpose of lowering the driving device 20 tending to being driven to turn by pawl 30 when the handle 10 is turned reversibly, the present invention provides a supporting device 50 with lighter weight. As discuss above, the spring 60 has its limitation to reduce its spring force, the lighter supporting device 50 will provide the pawl 30 can depart from driving device 20 easier when the handle 10 is turned reversibly so that the driving device 20 will has less chance to be turned by the pawl 30 when the handle 10 is turned reversibly.

The conventional ratchet wrench provided the bullet or the piece-like supporting device to be against the pawl. The condition of the bullet-like or the piece-like supporting device contacting the pawl is a point. That might cause the pawl can not mesh its all teeth with the teeth of the driving device when the supporting device is not against the pawl at the position of center of gravity thereof The supporting device 50 of the present invention provides the contacting segment 52 against the pawl 30. The condition of the contacting segment 52 against the pawl 30 is a line that may provide the pawl 30 having a stable condition to mesh with the driving device 20 or to be moved.

The extending segment 51 of the supporting device 13 will be against a top sidewall of the fist chamber 13 when the axle member 41 of the switching device 40 tends to escape out of the second chamber 14. That can prevent the switching device 40 loosing from the handle 10.

The contacting segment 52 of the supporting device 50 will fall into the recesses 342 on the opposite sides of the driven portion 34 of the pawl 30 respectively when it is moved to lift or right. The recesses 342 can position the supporting device 50 therein to replace the positioning member 87 of the conventional ratchet wrench 8 or 9.

The lug portions 341 at opposite ends of the driven portion 34 of the pawl 30 are the highest portions thereof. They can stop the contacting segment 52 to prevent it escape from the driven portion 34 when the switching device 40 is over turned.

What is claimed is:

1. A ratchet wrench, comprising:

a handle having a head portion at an end thereof, a through hole, a first chamber and a second chamber at said head portion, wherein said first chamber has opposite sides thereof communicated with said through hole and said second chamber respectively;

a driving device having a polygonal hole at a center thereof and teeth at an outer surface thereof installed in said through hole of said handle for free rotation;

a pawl having teeth at a side thereof and a driven portion at an opposite side thereof movably received in said first chamber to detachably mesh said teeth thereof with said teeth of said driving device;

a switching device having an axle member and a turning member at an end of said axle member, wherein said axle member is received in said second chamber of said handle for free rotation and said turning member is left out of said handle;

a supporting device, which is substantially a U-shaped element, having two substantially parallel extending segments and a contacting segment with opposite ends thereof connected with distal ends of said extending segments, wherein free proximal ends of said extending segments are movably connected with said axle member of said switching device and said contacting segment is received in said first chamber of said handle, and biasing means elastically urging said contacting segments of said supporting device against said pawl at said driven portion.

2. The ratchet wrench as defined in claim 1, comprising a spring received by one of said extending segments, the spring having an end thereof against said axle member and another end thereof against said contacting segment.

3. The ratchet wrench as defined in claim 1, wherein said axle member of said switching device has a flat face on which has two holes and said extending segments of said supporting device each having a proximal end inserted into the two holes.

4. The ratchet wrench as defined in claim 3, wherein said axle member further has two inclined faces at opposite ends of said flat face respectively.

5. The ratchet wrench as defined in claim 1, wherein said pawl has two recesses on said driven portion.

6. The ratchet wrench as defined in claim 1, wherein said pawl has two lug portions respectively at opposite ends thereof said driven portion.

* * * * *